United States Patent [19]

Poklekowski et al.

[11] 4,191,497

[45] Mar. 4, 1980

[54] MINE ROOF SUPPORTS

[75] Inventors: Helmut Poklekowski, Lunen; Klaus Seeberger, Werne; Gunther Harmsma, Bergkamen-Oberberge, all of Fed. Rep. of Germany

[73] Assignee: Gewerkschaft Eisenhutte Westfalia, Lunen, Fed. Rep. of Germany

[21] Appl. No.: 921,231

[22] Filed: Jul. 3, 1978

[30] Foreign Application Priority Data

Jul. 5, 1977 [DE] Fed. Rep. of Germany ..... 2730295

[51] Int. Cl.[2] ..... E21D 15/44

[52] U.S. Cl. ..... 405/296; 405/291

[58] Field of Search ..... 405/296, 294, 295, 292; 299/31-33; 91/170 MP

[56] References Cited

U.S. PATENT DOCUMENTS

| | | | |
|---|---|---|---|
| 3,800,546 | 4/1974 | Holken et al. | 405/296 |
| 3,996,753 | 12/1976 | Lubojatsky et al. | 405/296 X |
| 4,118,939 | 10/1978 | Sanders | 405/296 |

FOREIGN PATENT DOCUMENTS

| | | | |
|---|---|---|---|
| 1937308 | 2/1971 | Fed. Rep. of Germany | 405/296 |
| 2160651 | 6/1973 | Fed. Rep. of Germany | 405/296 |
| 2212994 | 9/1973 | Fed. Rep. of Germany | 405/296 |

*Primary Examiner*—Dennis L. Taylor

*Attorney, Agent, or Firm*—Thompson, Birch, Gauthier & Samuels

[57] ABSTRACT

A roof support unit for a walking frame roof support assembly is provided with a two part goaf shield. One the goaf shield parts is connected, by means of a link, to the roof cap of the unit; the other goaf shield part being connected, by means of a link, to the floor sill of the unit; and the two parts being hinged to one another. At least one of the links is such as to permit the roof cap to be retracted by an amount sufficient to permit the advance of the unit while preventing the hinged connection between the two goaf shield parts moving towards the goaf side of the mine working.

13 Claims, 7 Drawing Figures

MINE ROOF SUPPORTS

BACKGROUND OF THE INVENTION

This invention relates to mine roof supports, and in particular to a mine roof support unit for a walking frame roof support assembly, the unit having a two-part goaf shield fitted between its roof cap and its floor sill.

Roof support units having two-part goaf shields are known, the two parts of such shields being hinged together in such a manner that the hinge moves towards the goaf side of a mine working as the roof support props of the unit are retracted. Thus, DT-OS No. 2,448,367 and U.S. Pat. No. 3,483,705 each discloses a roof support unit of this type, the goaf shield being pivotably mounted on the roof cap by means of pin-and-slot connections. This permits the roof cap to tilt slightly so as to accommodate variations in the roof of the working.

DT-OS No. 1,237,308 also discloses a roof support unit having a two-part hinged goaf shield. The two goaf shield parts are hinged respectively to the roof cap and the floor sill of the unit so that, as the roof support props are retracted, the hinge between the two goaf shield parts moves towards the goaf side of the working. DT-AS No. 2,403,834 discloses a two-part goaf shield which is connected to the roof cap by means of a universal joint which permits the roof cap to tilt to accommodate roof unevenness without deformation forces acting on the goaf shield. The universal joint also has the effect of limiting the tilting movement of the cap about its longitudinal axis, so that excessive tilting of the cap, in the unloaded condition, is prevented.

The disadvantage of all these known arrangements is that the load acting on the goaf shield, owing to the presence of rock and rubble in the goaf side of the working, may hinder or even prevent the hinge connection between the two parts of the shield moving, and hence lowering of the roof cap and advance of the unit may be prevented.

The main object of the invention is to provide a mine roof support unit of the initially stated type, whose goaf shield is such that the roof cap can be lowered sufficiently to permit advance of the unit, without the hinge connection between the two shield parts moving towards the goaf side of the working.

Another object of the invention is to ensure, as far as is possible, considerable relative mobility between the roof cap and the goaf shield, and to prevent forces, which otherwise severely limit the mobility of the cap and its ability to adapt to any unevenness of the roof, from being transmitted to the shield by way of the cap.

Yet another object is to provide an advantageous arrangement for shielding the sides of the roof support unit.

SUMMARY OF THE INVENTION

The present invention provides a mine roof support unit comprising a floor sill, a roof cap supported on the floor sill by hydraulic prop means, and a goaf shield fitted between the roof cap and the floor sill, the goaf shield being constituted by two shield plates hinged together, the upper shield plate being connected to the roof cap by a first link, and the lower shield plate being connected to the floor sill by a second link, wherein the first link incorporates lost motion whereby the roof cap can be lowered sufficiently to permit the advance of the unit without the hinge connection between the two shield parts moving towards the goaf side of the working.

Thus, the lost motion in the first link (vertical play) is at least of such magnitude that it corresponds to the prop retraction necessary for the advance of the unit. Generally, the amount of lost motion is less than the thickness of the roof cap.

With this type of apparatus, the roof cap can be lowered sufficiently to permit the unit to be advanced without the hinge connection between the two shield plates having to move towards the goaf and overcome the load of any rock or rubble present. At the same time, the goaf shield is guided efficiently and is accompanied by substantial automotic mobility of the roof cap.

Advantageously, the first link comprises a first link member connected to the roof cap, and a second link member connected to the upper shield plate, the second link member being slidable relative to the first link member.

Preferably, the first link member is provided with an elongate slot, the second link member being slidable within said slot. In one embodiment, said slot in the first link member is a vertical slot. In this case, the first link member may be connected to the roof cap by means of a pivot pin supported by bracket means fixed to the roof cap, the axis of the pivot pin being at right-angles to that of said slot. This type of link has the added advantage of serving to limit lateral tilting of the roof cap.

Advantageously, the roof cap is provided with an integral, downwardly depending, inclined deflector plate, the first link member being fastened to the underneath surface of said deflector plate. In this case, the first link member may be provided with an elongate slot which extends parallel to the underneath surface of said deflector plate, the second link member being slidable within said slot. Alternatively, the first link member is a rod which extends parallel to the underneath surface of said deflector plate, the second link member being slidable along said rod. In either case, the second link member may also swivel with respect to the first link member. The deflector plate is of such a length that the hinge always lies below its protection even when the props are fully retracted. This means that the goaf shield is unlikely to be subjected to heavy loads from the goaf space. Moreover, the provision of the first link on the underneath of the deflector plate means that, when the props are fully retracted, the upper shield plate lies immediately below the deflector plate, so that a space-saving arrangement is achieved.

Advantageously, the hinge connection between the two shield plates is formed with stop means which define an upper limit and/or a lower limit to the angle between the two shield plates. These stop means serve to limit the extension of the props and to ensure that any forces acting on the lower shield plate (arising from pressure of rock and rubble in the goaf space) are not transferred through the hinge onto the upper shield plate and the roof cap, but to the floor sill. Preferably, however, the hinge connection is formed with stop means which define said lower limit and the second link is formed with stop means which define said upper limit.

The upper shield plate may be provided with side walls which serve to provide lateral screening and support and, if required, to provide lateral guides for the adjoining roof support unit. Advantageously, said side walls are provided with detachable, downwardly depending side wall plates. These side wall plates are only needed where the unit is used with thick seams which require maximum extension of the props. In such cases, the side walls of the upper shield plate do not provide adequate lateral screening and so the additional side wall plates are necessary.

Preferably, the roof cap is provided with downwardly depending side plates which overlap said side walls, or said side wall plates. This results in the unit being completely screened at its sides.

According to another aspect of the invention there is provided a mine roof support unit having a roof cap supported above a floor sill by means of hydraulic props, a two-part goaf shield being fitted between the roof cap and the floor sill, a goaf shield being connected to the roof cap and to the floor sill by respective links, and the two parts of the goaf shield being hinged together, the improvement comprising forming at least one of said links with a predetermined degree of vertical play whereby the roof cap can be lowered sufficiently to permit advance of the unit without the hinge connection between the two parts of the goaf shield moving towards the goaf side of the working.

BRIEF DESCRIPTION OF THE DRAWINGS

Several forms of roof support unit, each constructed in accordance with the invention, will now be described, by way of example, with reference to the accompanying drawings, in which.

DESCRIPTION OF PREFERRED EMBODIMENTS

Figure 1:
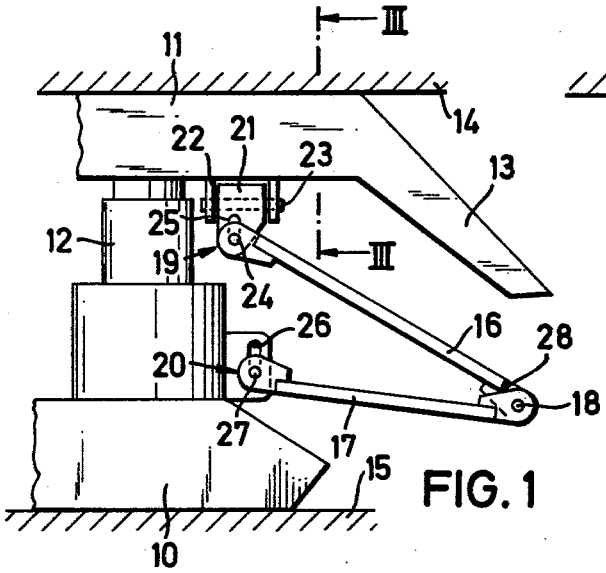
FIG. 1 is a side elevation of part of a first form of roof support unit shown with its roof support props retracted.

In each of the drawings, the numeral 10 designates a floor sill, the numeral 11 a roof cap, and the numeral 12 a hydraulic roof support prop of a roof support unit of known type. In each case, both the floor sill 10 and the roof cap 11 can be of multi-part construction. As is standard practice, each roof support unit will have a plurality (say four) of hydraulic props 12. At the rear, goaf side, each of the roof caps 11 is provided with an integral downwardly inclined deflector plate 13 which diverts rocks which break away from the roof 14 of the mine working.

Figure 3:
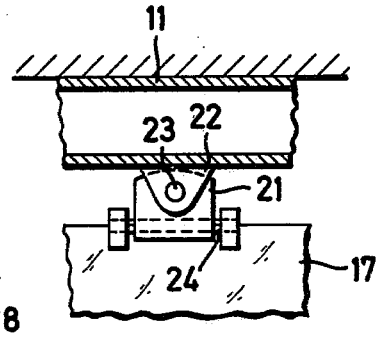
FIG. 3 is a cross-section taken on the line III—III of FIG. 1.
Figure 2:
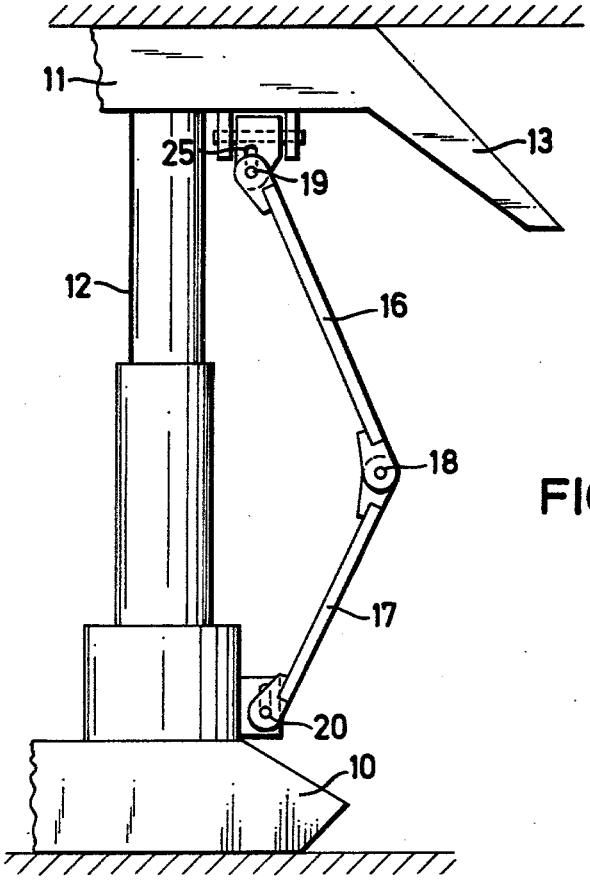
FIG. 2 is a view similar to that of FIG. 1, but showing the props extended.

Referring now to FIGS. 1 to 3, the first form of roof support unit is provided with a goaf shield constituted by two shield plates 16 and 17 which are pivotably connected together by means of a hinge 18. The upper shield plate 16 is coupled, by means of a link 19, to the roof cap 11, and the lower shield plate 17 is coupled, by way of a link 20, to the floor sill (or—as illustrated—to a part fixed to the floor sill). The link 19 has a link member 21 pivotably supported between a pair of brackets 22 by a pivot pin 23, the brackets being fixed to the underside of the roof cap 11 forwardly of the deflector plate 13, and the axis of the pivot pin 23 lying parallel to longitudinal axis of the roof cap. The upper shield plate 16 is coupled to the link member 21 by means of a pivot pin 24 which is received within a vertical slot 25 in the link member 21, the axis of the pivot pin 24 being at right-angles to that of the pivot pin 23. Thus, the upper shield plate 16 is coupled to the roof cap 11 in such a manner as to allow a limited degree of vertical play. Similarly, the lower shield part 17 is coupled to the floor sill 10 by the link 20 so as to allow a limited degree of vertical play; the link 20 being constituted by a vertical slot 26, formed in the part fixed to the floor sill, and by a pivot pin 27 fastened to the shield plate 17.

It will be apparent that, when the roof support props 12 are fully retracted, the shield plates 16 and 17 are in the relative positions shown in FIG. 1 and, when the props are fully extended so as to support the roof of the working, the shield plates are in the relative positions shown in FIG. 2. Thus, as the props 12 are retracted towards the FIG. 1 position, the hinge 18 moves towards the goaf side of the working. However, the vertical play provided by the links 19 and 20 is sufficiently large to enable the props 12 to be retracted by an amount sufficient to relieve the load on the roof cap 11 (and hence permit the roof support unit to be advanced), without the hinge 18 moving towards the goaf side of the working. Thus, there is no chance of rock or rubble in the goaf space hindering or preventing the lowering of the roof cap or the advance of the unit.

It will also be apparent, from FIGS. 1 and 2, that both shield plates 16 and 17 lie at all times beneath a protective cover supplied by the rear end of the roof cap 11 and the deflector plate 13. Moreover, the deflector plate 13 extends downwardly to such an extent as to prevent, to a large extent, rock fragments loading the upper shield plate 16.

The hinge 18 is formed with interlocking stop members which abut (as shown at 28 in FIG. 1) to limit the reduction in the angle between the two shield plates 16 and 17 as the props 12 are retracted. In a similar manner, a mechanical limitation of the increase in the angle between the two shield plates 16 and 17, upon extension of the props 12, can be provided by similar stop means incorporated into the hinge 18 or into the lower link 20.

Each of the props 12 may be constituted by a multiple telescopic prop arrangement so as to increase the range over which it can be extended and retracted. However, whether the props 12 are single or multiple, the goaf shield arrangement described above provides adequate protection against rubble over the entire working strokes of the props.

Figure 4:
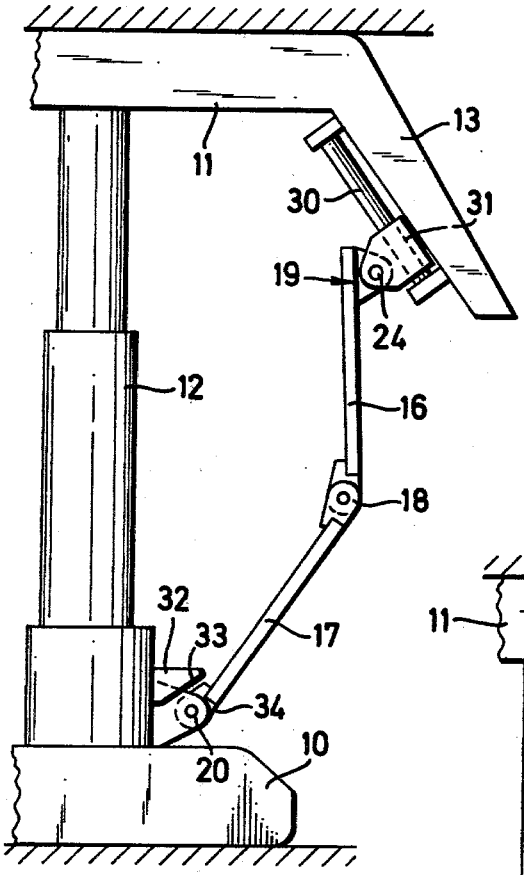
FIG. 4 is a side elevation of part of a second form of roof support unit whose props are shown extended.

In the second form of roof support unit, illustrated in FIG. 4, the upper link 19 is provided on the underneath surface of the deflector plate 13. Here, the link 19 has a link member 31, pivotably connected by means of a pivot pin 24 to the upper shield plate 16, slidably arranged on a rod 30 fastened to the underneath surface of the deflector plate 13. The movement of the link member 31 along the rod 30 provides a degree of vertical play sufficient to permit the props 12 to be retracted to permit advance of the roof support unit, whilst preventing the hinge 18 from moving towards the goaf side of the working.

The lower shield plate 17 is connected to a part fastened to the floor sill by a link 20 in a similar manner to that of the embodiment of FIGS. 1 to 3, the only difference being that here the link 20 is not designed to provide vertical play. The vertical play necessary to permit advance of the unit is, in this embodiment, all supplied by the top link 19. The lower shield plate 17 is connected to the link 20 by means of a link member 34 which co-operates with a face 33 of a stop member 32 fastened to floor sill 10 to limit the increase in the angle between the two shield plates 16 and 17 as the props 12 are extended. As in the embodiment of FIGS. 1 to 3, limitation of the decrease in the angle between the plates 16 and 17, upon retraction of the props 12, is achieved by stop members on the hinge 18. Here again, the hinge 18 always lies below the protective cover of the rear of the roof cap 11 and the deflector plate 13.

Figure 5:
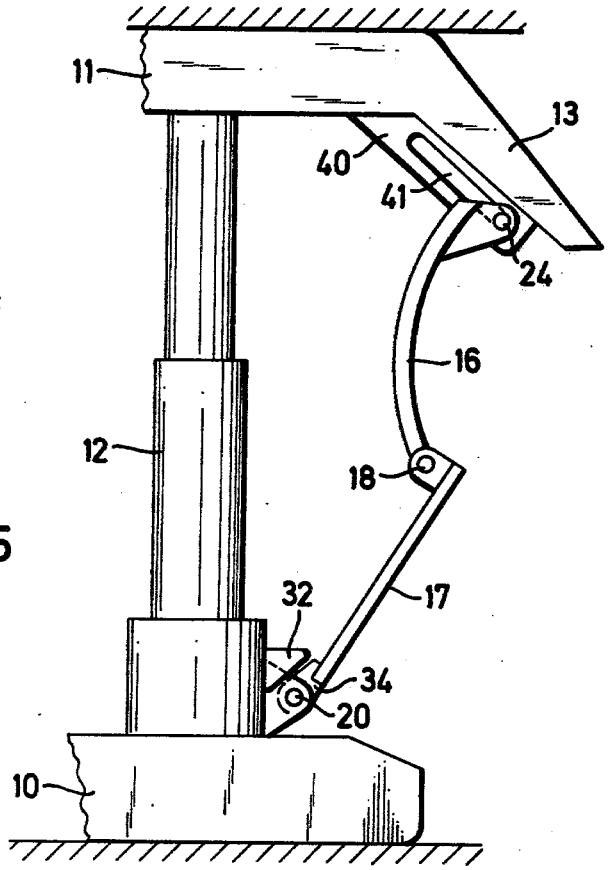
FIG. 5 is a side elevation of part of a third form of roof support unit whose props are shown extended.

The embodiment of FIG. 5 differs from that of FIG. 4 in only three ways. Firstly, the upper link 19 is constituted by a guide plate 40, fixed to the underneath of the deflector plate 13, and a pin 24 fixed to the upper end of the shield plate 16 and slidable within a slot 41 formed in the plate 40. This sliding movement of the pin 24 in the slot 24 provides the required amount of vertical play. Secondly, the upper shield plate 16 is curved, being concave towards the goaf side of the working, and thirdly, the hinge 18 is of a different form.

In each of the embodiments of FIGS. 4 and 5, the upper shield plate 16 is connected to the deflector plate 13. This results in the upper shield plate 16 adopting a generally vertical position when the props 12 are fully extended. This results in the upper shield plate 16 being subject to hardly any load arising from rocks which lie on the roof support unit. Moreover, rocks which fall onto the unit from the roof 14 of the working are prevented from hitting the upper shield plate 16 by the deflector plate 13, so that there is very little chance of the shield plate 16 and its connecting parts suffering damage from falling rocks.

Figure 6:
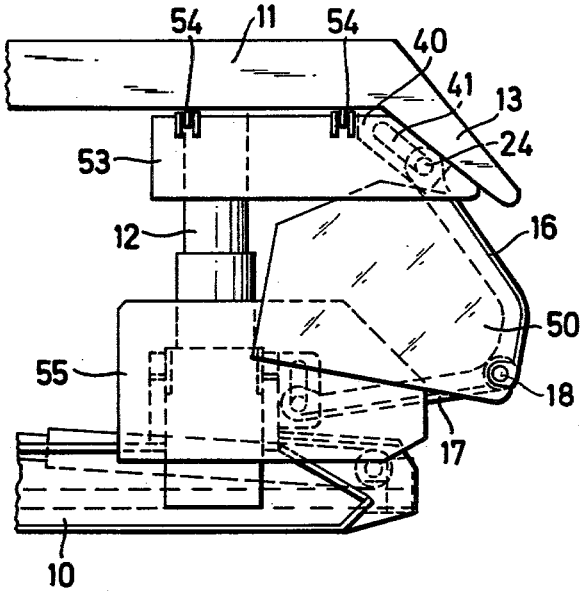
FIGS. 6 and 7 are side elevations of part of a fourth form of roof support unit whose goaf shield incorporates protective side plates.
Figure 7:
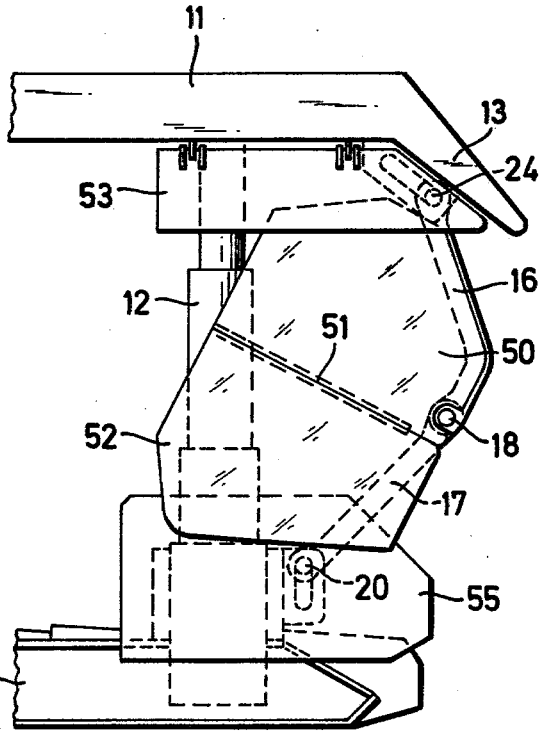

The embodiment of FIGS. 6 and 7 is similar to that of FIG. 5, in that the two-part goaf shield 16, 17 is slidingly connected to the underneath of the deflector plate 13 by means of a link constituted by a guide plate 40 having a slot 41 co-operating with a pin 41 attached to the upper shield plate 16. This embodiment is also similar to that of FIGS. 1 to 3 in that the lower link 20 between the lower shield plate 17 and the floor sill 10 is arranged to provide a degree of vertical play.

In this embodiment, however, the upper shield plate 16 is provided with a pair of side walls 50 so that a U-shaped shield member results. The side walls 50 are of a height that corresponds substantially to that of the shield plate 16. Further side wall members 52 may be detachably secured to the lower edges 51 of the side walls 50. Fixing means (not shown) such as a flange provided with bolt holes, are provided at the lower edges 51 of the side walls 50 for the detachable fixing of the side wall members 52. When the roof support unit is used in shallow seams, where the props 12 are extended to only about half their maximum length, the side wall members 52 are not necessary since the side walls 50 provide adequate screening (see FIG. 6). However, when the unit is used in thick seams, where the props 12 are fully extended, the side wall members 52 are attached to the side walls (see FIG. 7) to provide adequate lateral screening.

In order to complete the lateral screening, the roof cap 11 is provided with a pair of side plates 53 which are hinged thereto at 54, and the floor sill is provided with upstanding wall plates 55. The side plates 53 overlap the side walls 50, and the side walls 50 (or the side wall members 52) overlap the wall plates 55.

In each of the illustrated embodiments, the degree of vertical play in the link 19 and for the link 20 is less than the thickness of the roof cap 11.

We claim:

1. A mine roof support unit comprising a floor sill, a roof cap supported on the floor sill by hydraulic prop means, and a goaf shield fitted between the roof cap and the floor still, the goaf shield being constituted by two shield plates hinged together, the upper shield plate being connected to the roof cap by a first link, and the lower shield plate being connected to the floor sill by a second link, the first link incorporating lost motion whereby the roof cap can be lowered sufficiently to permit the advance of the unit without the hinge connection between the two shield parts moving towards the goaf side of the working, wherein the first link comprises a first link member connected to the roof cap, and a second link member connected to the upper shield plate, the second link member being slidable relative to the first link member, and wherein the roof cap is provided with an integral, downwardly depending, inclined deflector plate, the first link member being fastened to the underneath surface of said deflector plate, the second link member being slidable relative to the first link member in a direction parallel to the underneath surface of said deflector plate.

2. A unit according to claim 1, wherein the amount of lost motion is less than the thickness of the roof cap.

3. A unit according to claim 1, wherein the first link member is provided with an elongate slot which extends parallel to the underneath surface of said deflector plate, the second link member being slidable within said slot.

4. A unit according to claim 1, wherein the first link member is a rod which extends parallel to the underneath surface of said deflector plate, the second link member being slidable along said rod.

5. A unit according to claim 1, wherein the hinge connection between the two shield plates is formed with stop means which define an upper limit to the angle between the shield plates.

6. A unit according to claim 1, wherein the hinge connection between the two shield plates is formed with stop means which define a lower limit to the angle between the shield plates.

7. A unit according to claim 1, wherein the second link is formed with stop means which define an upper limit to the angle between the two shield plates.

8. A unit according to claim 1, wherein the upper shield plate is provided with side walls.

9. A unit according to claim 8, wherein said side walls are provided with detachable, downwardly depending side wall plates.

10. A unit according to claim 8, wherein the roof cap is provided with downwardly depending side plates which overlap said side walls.

11. A unit according to claim 8, wherein the floor sill is provided with upwardly extending side plates which overlap said side walls.

12. A unit according to claim 9, wherein the floor sill is provided with upwardly extending side plates which overlap said side wall plates.

13. A mine roof support unit comprising a floor sill, a roof cap supported on the floor sill by hydraulic prop means, and a goaf shield fitted between the roof cap and the floor sill, the goaf shield being constituted by two shield plates hinged together, with upper shield plate being connected to the roof cap by a first link and the lower shield plate being connected to the floor sill by a second link, wherein the first link incorporates lost motion whereby the roof cap can be lowered sufficiently to permit the advance of the unit without the hinge connection between the two shield parts moving towards the goaf side of the working, and wherein the second link incorporates lost motion whereby the floor sill can adapt itself to irregularities in the floor of the mine working.

* * * * *